US008910426B2

(12) United States Patent
Peck et al.

(10) Patent No.: US 8,910,426 B2
(45) Date of Patent: Dec. 16, 2014

(54) HIDDEN DOWN SPOUT SYSTEM

(71) Applicants: Robert William Peck, Cedar Rapids, IA (US); Mark William Loughren, Cedar Rapids, IA (US); Micahel John Moleski, Cedar Rapids, IA (US)

(72) Inventors: Robert William Peck, Cedar Rapids, IA (US); Mark William Loughren, Cedar Rapids, IA (US); Micahel John Moleski, Cedar Rapids, IA (US)

(73) Assignee: Marpec, Inc., Cedar Rapids, IA (US)

( * ) Notice: Subject to any disclaimer, the term of this patent is extended or adjusted under 35 U.S.C. 154(b) by 0 days.

(21) Appl. No.: 13/769,216

(22) Filed: Feb. 15, 2013

(65) Prior Publication Data

US 2013/0205684 A1 Aug. 15, 2013

Related U.S. Application Data

(60) Provisional application No. 61/599,067, filed on Feb. 15, 2012.

(51) Int. Cl.
*E04D 13/00* (2006.01)
*E04D 13/08* (2006.01)

(52) U.S. Cl.
CPC ..... *E04D 13/08* (2013.01)
USPC ..... 52/16; 52/11; 52/287.1; 248/48.2; 138/167

(58) Field of Classification Search
USPC ..... 52/16, 11, 12, 13, 287.1, 844; 248/48.1, 248/48.2; 138/168, 167
See application file for complete search history.

(56) References Cited

U.S. PATENT DOCUMENTS

| | | | | | |
|---|---|---|---|---|---|
| 3,612,453 | A * | 10/1971 | Zimmer | 248/48.2 |
| 4,632,342 | A * | 12/1986 | Skinner | 248/48.2 |
| 4,999,961 | A * | 3/1991 | McNary | 52/287.1 |
| 5,522,427 | A * | 6/1996 | Johnson | 137/616.5 |
| 6,041,555 | A * | 3/2000 | Alpi | 52/11 |
| 6,823,633 | B2 * | 11/2004 | Ryan | 52/302.1 |
| 6,883,282 | B1 * | 4/2005 | Newhart, III | 52/287.1 |
| 7,007,429 | B2 * | 3/2006 | Kim | 52/16 |
| 7,610,722 | B1 * | 11/2009 | Carroll | 52/16 |
| 2003/0037495 | A1 * | 2/2003 | Shaw | 52/287.1 |
| 2003/0221373 | A1 * | 12/2003 | Kim | 52/14 |
| 2009/0056252 | A1 * | 3/2009 | Taylor et al. | 52/287.1 |
| 2010/0126078 | A1 * | 5/2010 | Leahy | 52/16 |
| 2011/0056144 | A1 * | 3/2011 | Hicks | 52/12 |

* cited by examiner

*Primary Examiner* — Robert Canfield
*Assistant Examiner* — Babajide Demuren
(74) *Attorney, Agent, or Firm* — Richards Patent Law P.C.

(57) ABSTRACT

A hidden down spout system includes: a down spout receiver adapted to be secured to a building; a down spout adapted to be secured to the down spout receiver; a top conveyor arm adapted to receive water from a gutter; and a top cap connecting the top conveyor arm to the down spout such that water flowing from the top conveyor arm flows to the down spout. The down spout receiver may include: a sealing flange, one or more siding channels, a tab and a snap-lock tab; and a down spout adapted to snap-fit to the down spout receiver, wherein the down spout includes a socket adapted to receive the tab and further includes a ramp surface and retainer adapted to receive the snap-lock tab.

23 Claims, 13 Drawing Sheets

HIDDEN DOWN SPOUT SYSTEM

CROSS-REFERENCE TO RELATED APPLICATIONS

This application incorporates by reference and claims priority to U.S. Provisional Patent Application No. 61/599,067 filed Feb. 15, 2012.

BACKGROUND OF THE INVENTION

The present subject matter relates generally to a hidden down spout system. More specifically, the present subject matter discloses a down spout system in which down spouts are hidden inside of elements that resemble the inside and outside corner trims used in standard siding installations.

Down spouts are used to carry water from gutters and direct that water to appropriate discharge areas. Typically, down spouts are vertical pipes that direct rainwater (and melted snow, etc.) from a building's elevated rain gutters to the ground level. At the ground level, the water is directed away from the building's foundation either directly to a sewer or to an area appropriate for rainwater harvesting or for safe infiltration into the ground.

To many homeowners, down spouts are a necessary evil. They are functionally essential to maintain proper drainage around the home and help to keep the lower level of the home dry, but they are an eye sore.

Accordingly, there is a need for a system that may be used to improve the aesthetic quality of down spout systems, as described and claimed herein.

BRIEF SUMMARY OF THE INVENTION

The present disclosure provides a hidden down spout system in which the down spouts are installed such that they are incorporated into the home's siding in a way that the down spouts are not apparent as independent objects hanging from the building. Rather, the integrated down spout system seamlessly incorporates into the siding to provide a consistent and aesthetically pleasing façade.

The hidden down spout system provided herein may be provided in any one or more of the following configurations: (a) an outside corner down spout assembly; (b) an inside corner down spout assembly; and (c) a straight down spout assembly. The various down spout assemblies may be adapted to be incorporated into a siding system (vinyl, wood, fiber cement, etc.) and/or a brick veneer or other building envelop, as will be apparent to those skilled in the art based on the disclosures provided herein. In contrast to existing down spout systems, in which the down spouts are independent pipes installed in front of the siding system exterior, the subject matter provided herein hides the downspouts from view, dramatically improving the aesthetic appearance of the drainage system and the home with which it is associated.

In one example, the hidden down spout system replaces a standard corner siding trim pieces with hidden down spouts and additionally, optionally, incorporates one or more straight down spout assembles between the corner trim pieces in a manner that appears to be an integrated vertical trim section, rather than an independent down spout. A two-piece snap-locking design enables one or more of the down spouts to be removable, though it is contemplated that, in some embodiments of the hidden down spout system, the down spouts may be non-removable.

In a presently preferred embodiment, each down spout assembly (outside corner, inside corner, straight) includes: a down spout; a down spout receiver; a top conveyor arm; a top cap; an optional down spout connector; a bottom down spout transition cap; and, optionally, an on-grade discharge transition cap, depending on whether a below grade storm water drain tile is being used.

In a typical installation, the top conveyor arm engages a rainwater gutter system at the building's eave, receives the water from the gutters, and conveys the water to the top cap. The top cap caps the top of the down spout and transitions the water from a generally horizontal flow to a generally vertical flow. The down spout receiver is installed directly against the building and receives the down spout. Should more than one length of down spout be needed (for example, in taller buildings), a down spout connecter joins the sections of down spout. At the bottom of the down spout, a down spout bottom transition cap makes the transition from the shape of the down spout to the shape of a standard below grade storm water drain tile. If a below grade drain tile is not being used, then an on-grade discharge transition cap makes the transition from the down spout bottom transition cap to a standard 4×5 down spout pipe and splash block.

In a preferred embodiment, the top conveyor arm, top cap, down spout connector, down spout bottom transition cap, and the on-grade discharge transition cap are injection molded using UV-PVC, the down spout receiver and the down spout are extruded using UV-PVC. However, it is understood that in various embodiments, the hidden down spout system may be made from other materials and other manufacturing processes. For example, in one contemplated embodiment, the down spout receiver and the down spout are manufacturer from extruded aluminum.

The difference between the various configurations (the outside corner down spout assembly, the inside corner down spout assembly, and the straight down spout assembly) is the cross-sectional shape of the down spouts and the transition pieces.

In one example, a hidden down spout system includes: a down spout receiver adapted to be secured to a building; a down spout adapted to be secured to the down spout receiver; a top conveyor arm adapted to receive water from a gutter; and a top cap connecting the top conveyor arm to the down spout such that water flowing from the top conveyor arm flows to the down spout. The hidden down spout system may be adapted to be secured to the down spout receiver through a snap fit connection.

In some embodiments, the down spout receiver includes a tab and a snap-lock tab and the down spout includes a socket adapted to receive the tab and further includes a ramp surface and retainer adapted to receive the snap-lock tab. The down spout receiver may further include a sealing flange and/or one or more siding channels. The hidden down spout system may further include a down spout transition cap adapted to mate with the down spout.

In another example, a hidden down spout system includes: a down spout receiver including a sealing flange, one or more siding channels, a tab and a snap-lock tab; and a down spout adapted to snap-fit to the down spout receiver, wherein the down spout includes a socket adapted to receive the tab and further includes a ramp surface and retainer adapted to receive the snap-lock tab.

The hidden down spout system may further include a top conveyor arm adapted to receive water from a gutter and a top cap connecting the top conveyor arm to the down spout such that water flowing from the top conveyor arm flows to the down spout.

The hidden down spout system may further include a down spout transition cap adapted to mate with the down spout and/or a down spout connector mating a second down spout to the down spout.

In another example, a hidden down spout system includes: a down spout unit including a sealing flange, one or more siding channels, and a down spout channel; a top conveyor arm adapted to receive water from a gutter; and a top cap connecting the top conveyor arm to the down spout such that water flowing from the top conveyor arm flows to the down spout. In one embodiment, the down spout unit includes a down spout and a down spout receiver, wherein the down spout receiver includes the sealing flange and the one or more siding channels and the down spout includes the down spout channel. In another embodiment, the down spout unit includes a down spout including the sealing flange, and the one or more siding channels, and the down spout channel and does not include a separate down spout receiver.

In some embodiments, the hidden down spout system further includes a down spout connector mating a second down spout to the first down spout. The hidden down spout system may be configured as an outside corner down spout, an inside corner down spout, or a straight down spout.

An advantage of the systems provided herein is that they provide a down spout system that improves the aesthetic character of the building.

Another advantage of the systems provided herein is that they provide a hidden down spout system that is hidden and invisible to the casual observer.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1A:
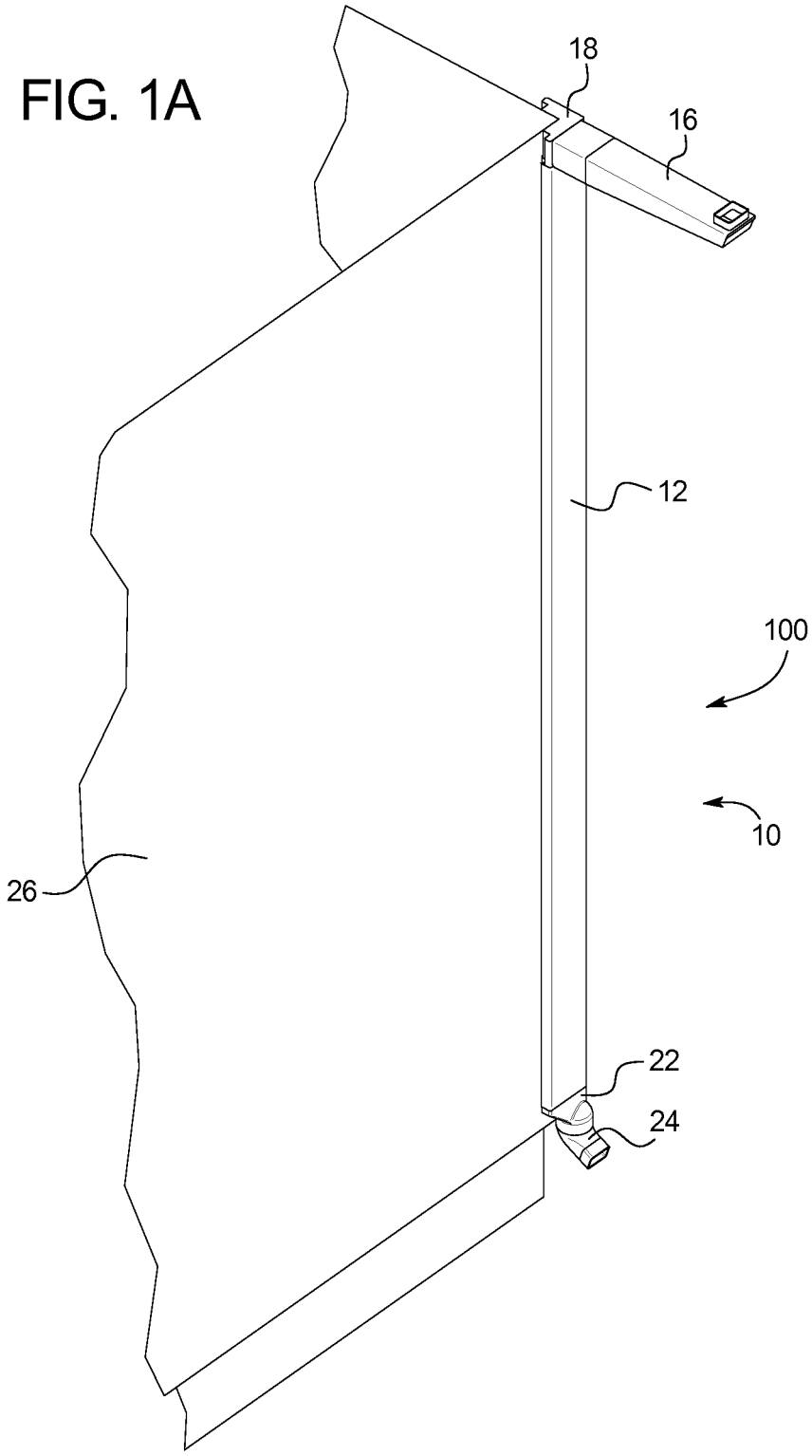
FIG. 1A is a perspective side view of a building showing an outside corner down spout assembly.

FIGS. 1-10 illustrate various views and examples of hidden down spout systems 10 as provided herein. The examples shown are merely illustrative examples of a hidden down spout system 10 and those skilled in the art will recognize the numerous variations of embodiments that may be implemented based on the teachings disclosed herein.

In the examples shown in FIGS. 1-10, a hidden down spout system 10 includes: a down spout 12; a down spout receiver 14; a top conveyor arm 16; a top cap 18; an optional down spout connector 20; a bottom down spout transition cap 22; and, optionally, an on-grade discharge transition cap 24.

Figure 1B:
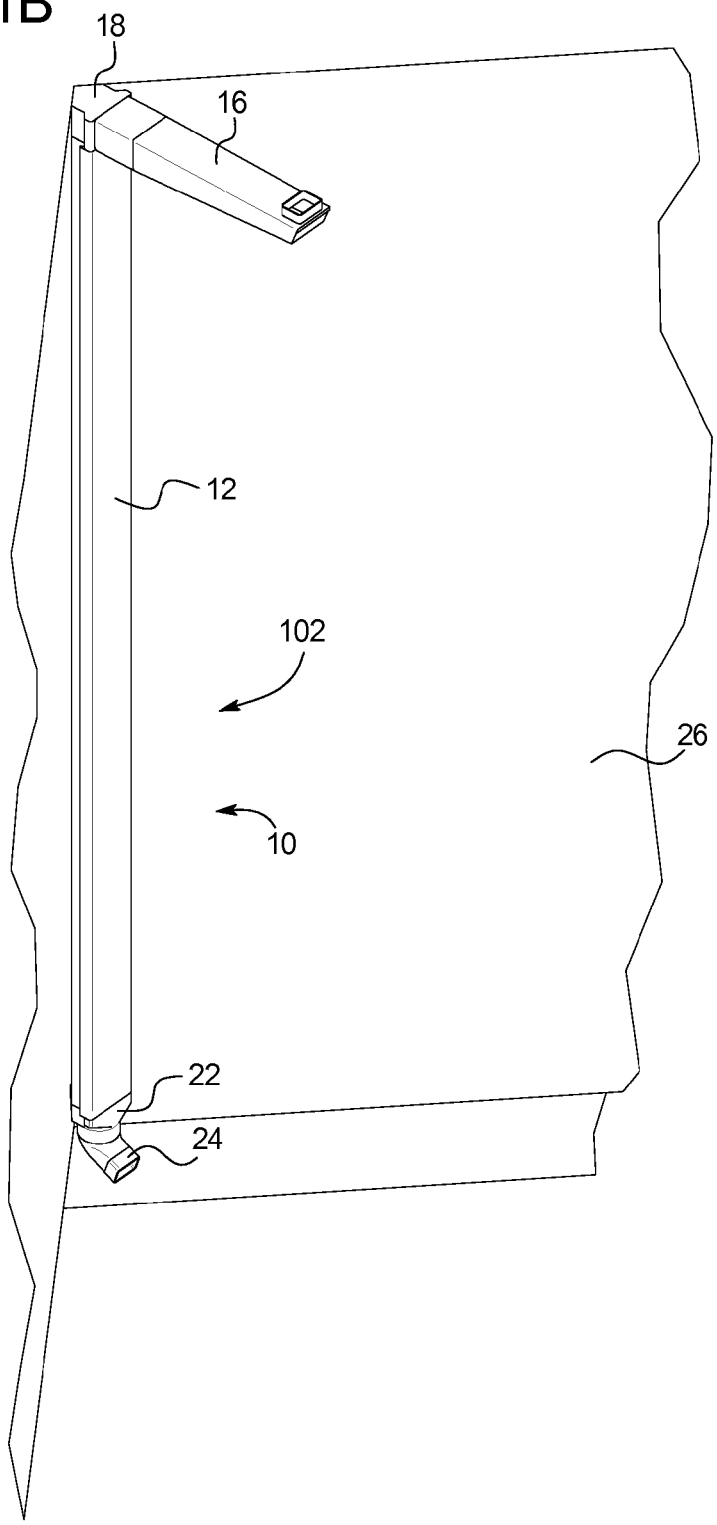
FIG. 1B is a perspective side view of a building showing an inside corner down spout assembly.
Figure 1C:
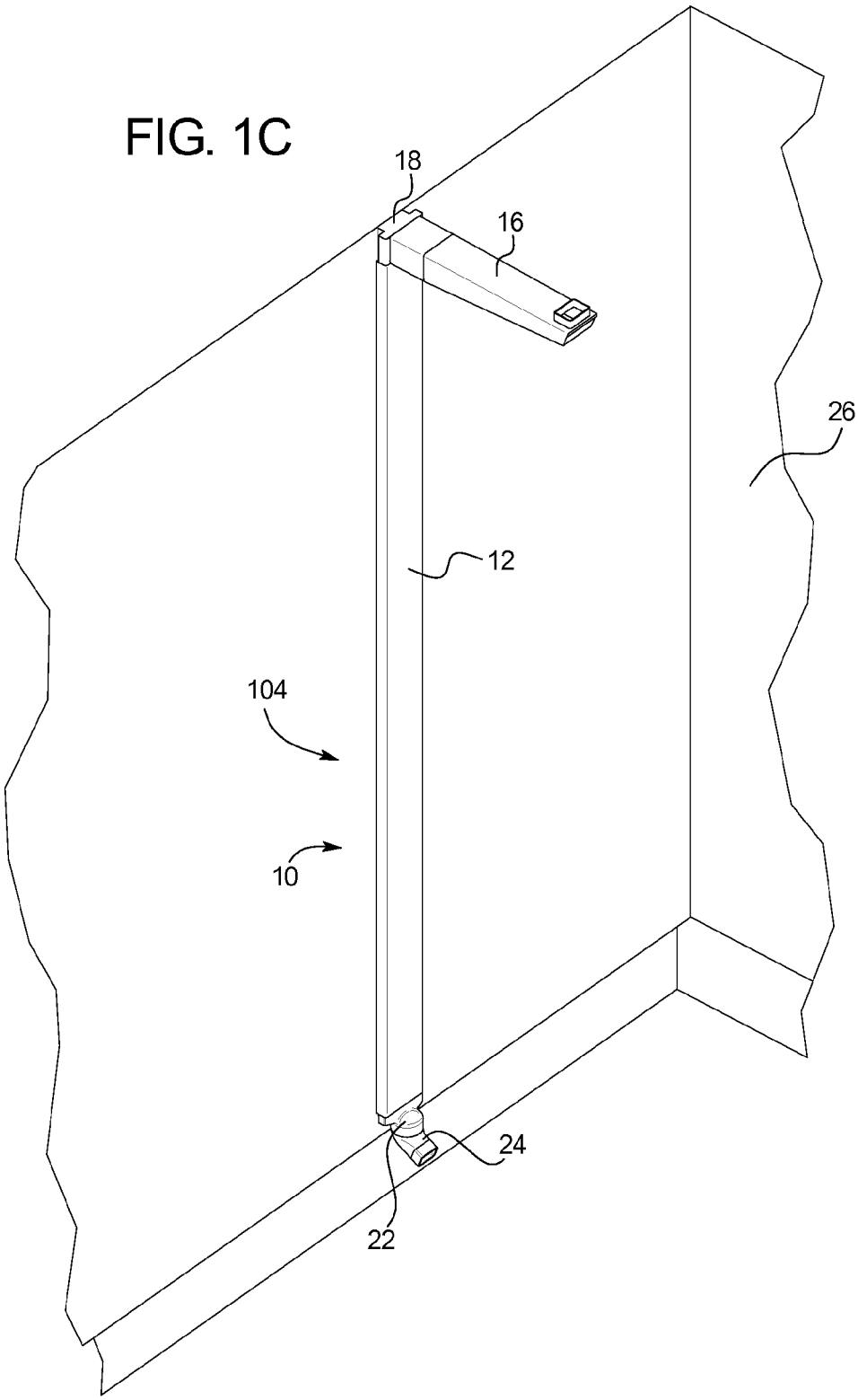
FIG. 1C is a perspective side view of a building showing a straight down spout assembly.
Figure 1D:
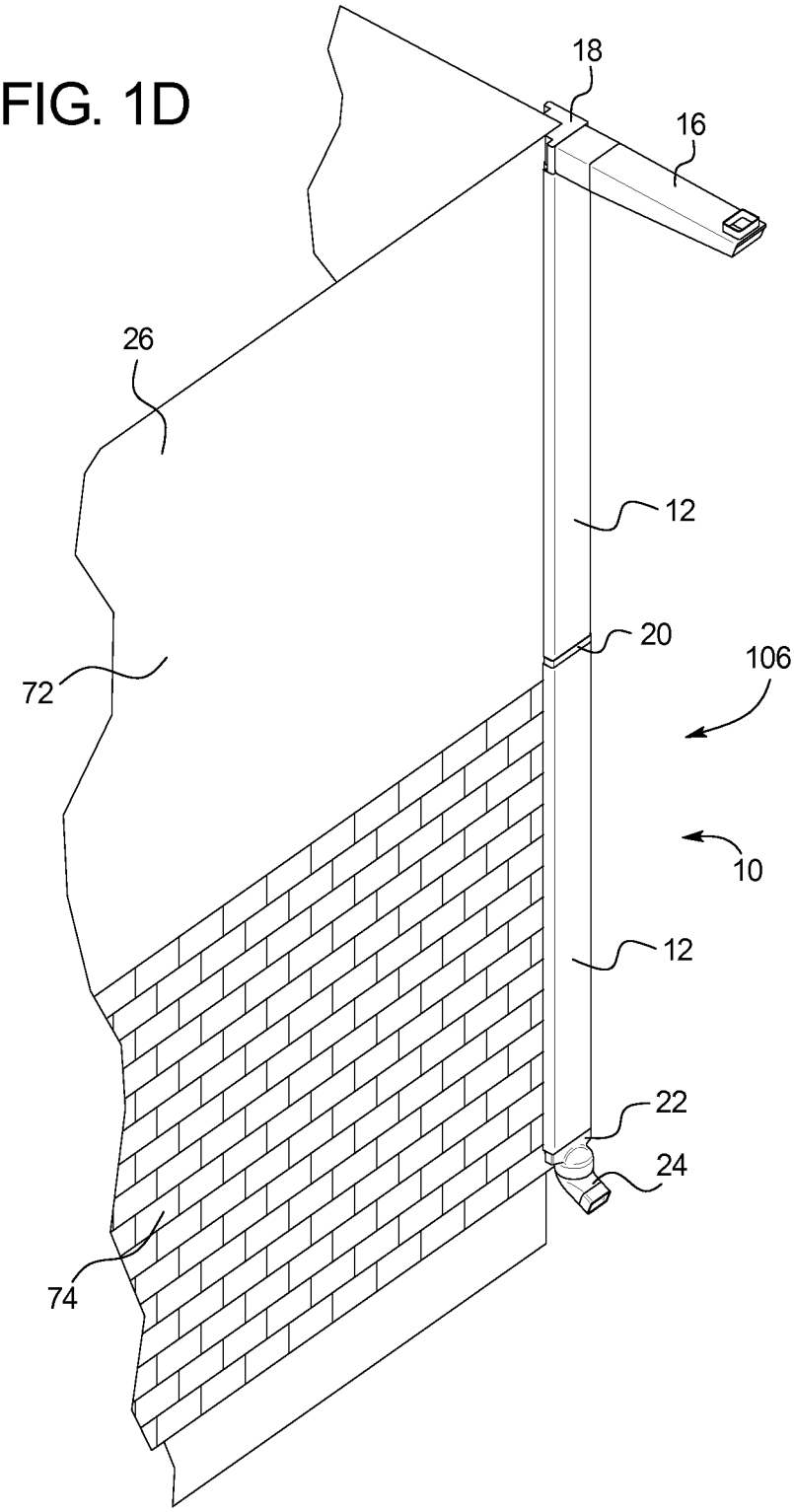
FIG. 1D is a perspective side view of a building showing an outside corner down spout assembly with brick transition.

FIGS. 1A-1D illustrate variations of the hidden down spout system 10. FIG. 1A shows an outside corner down spout assembly 100. FIG. 1B shows an inside corner down spout assembly 102. FIG. 1C shows a straight down spout assembly 104. FIG. 1D shows an outside corner down spout assembly with brick transition 106. Each are examples of a hidden down spout system 10 as provided herein and may be referred to specifically by their more descriptive names (i.e., outside corner down spout assembly 100, inside corner down spout assembly 102, straight down spout assembly 104, and outside corner down spout assembly with brick transition 106) or more generically as hidden down spout system 10.

Figure 2:
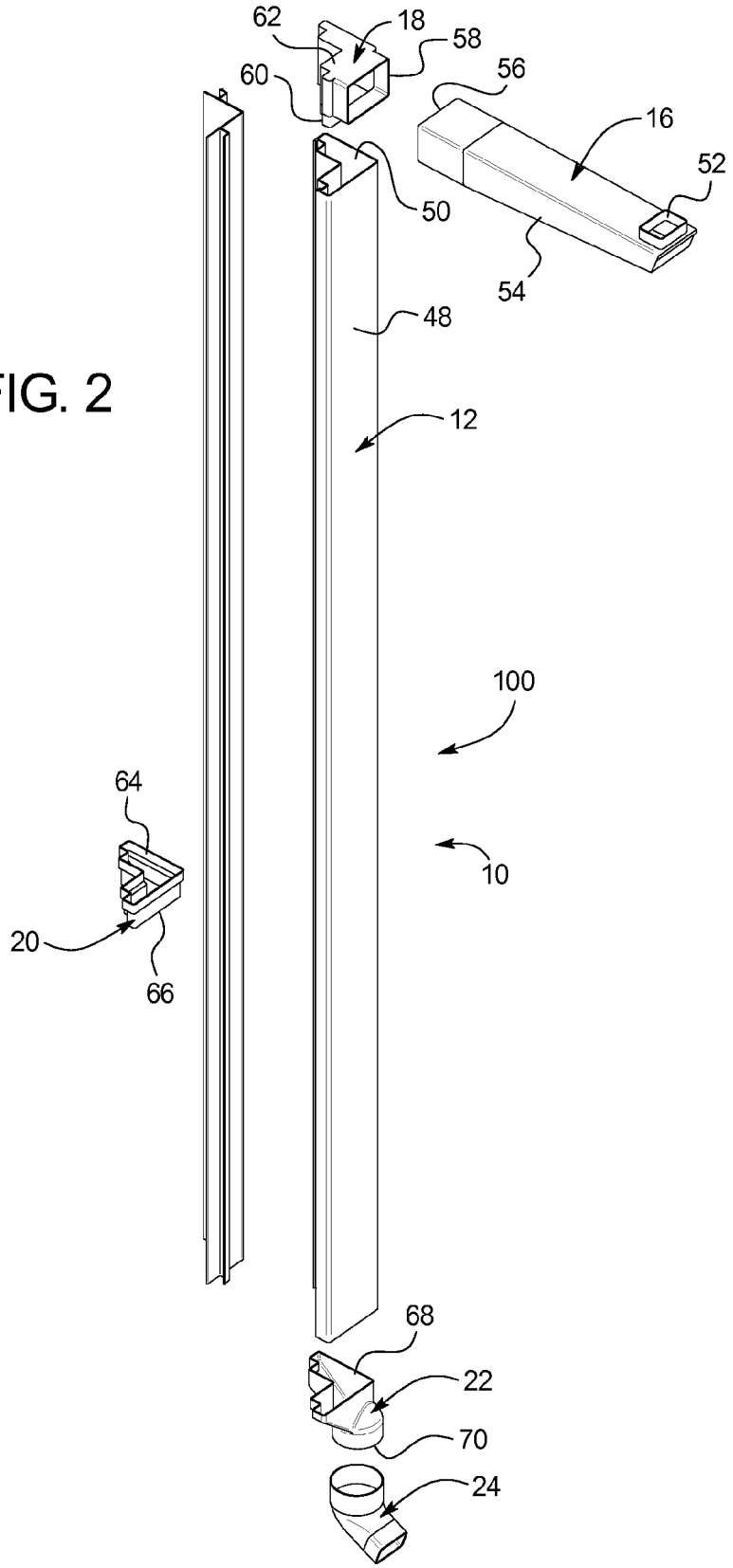
FIG. 2 is an exploded view of an outside corner down spout assembly.
Figure 3:
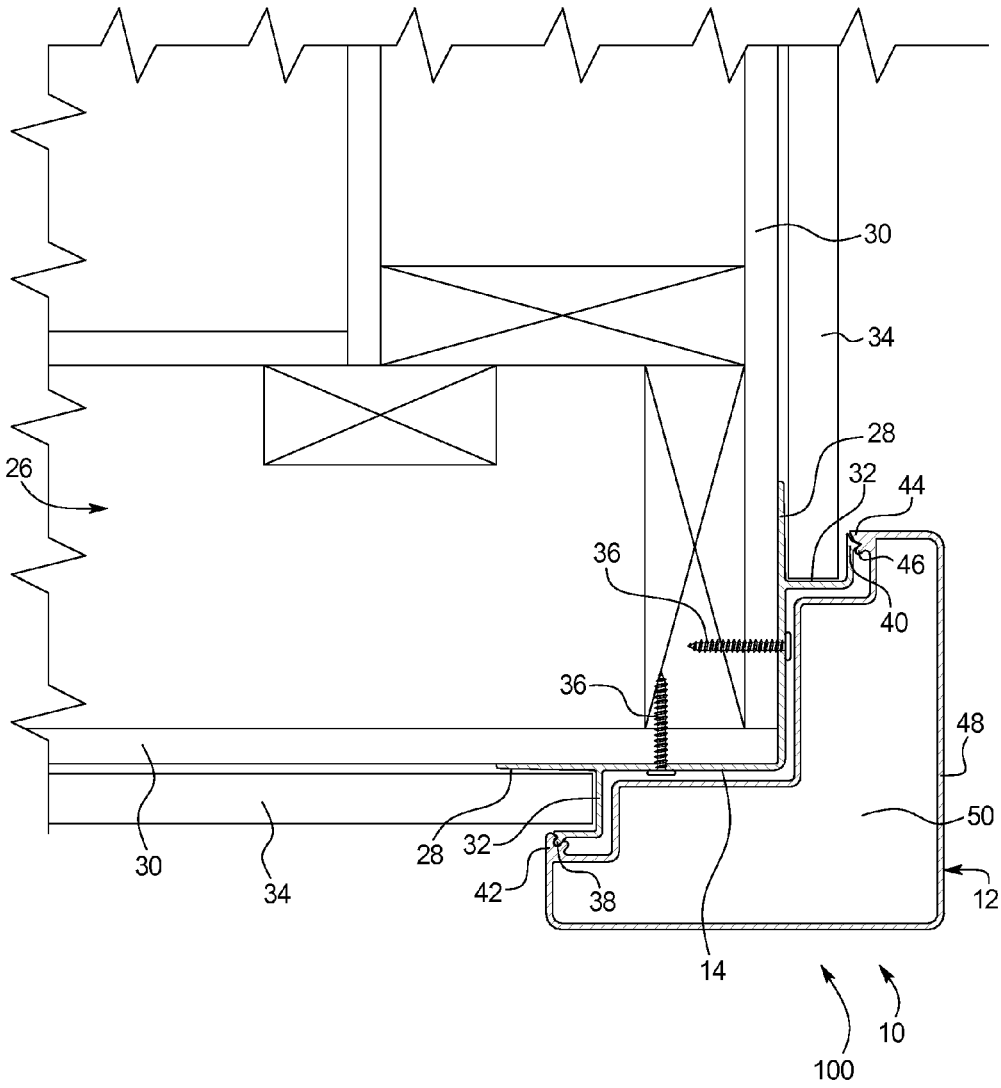
FIG. 3 is a cross-sectional view of the outside corner down spout assembly shown in FIG. 2, further illustrating the attachment of the outside corner down spout receiver to the building and the outside corner down spout to the outside corner down spout receiver.

FIGS. 1A, 2, and 3 show an outside corner down spout assembly 100. As shown, the outside corner down spout assembly 100 includes a down spout 12; a down spout receiver 14; a top conveyor arm 16; a top cap 18; an optional down spout connector 20; a bottom down spout transition cap 22; and, optionally, an on-grade discharge transition cap 24. The outside corner down spout assembly 100 replaces a standard outside corner siding trim pieces with a hidden down spout 12. In use, the top conveyor arm 16 engages a rainwater gutter system at the building's eave (not shown), receives the water from the gutters, and conveys the water to the top cap 18. The top cap 18 caps the top of the down spout 12 and transitions the water from a generally horizontal flow to a generally vertical flow. The down spout receiver 14 is installed directly against the building 26 and receives the down spout 12. Should more than one length of down spout 12 be needed (for example, in taller buildings 26), a down spout connecter 20 joins the sections of down spout 12. At the bottom of the down spout 12, a down spout bottom transition cap 22 makes the transition from the shape of the down spout 12 to the shape of a standard below grade storm water drain tile (not shown). If a below grade drain tile is not being used, then an on-grade discharge transition cap 22 makes the transition from the down spout bottom transition cap 22 to a standard 4×5 down spout pipe 24.

While shown in FIGS. 2 and 3 as a removable down spout 12 that snaps-locks into a down spout receiver 14, it is contemplated that embodiments of the outside corner down spout assembly 100 will not include a releasable snap-fit connection between the down spout 12 and the down spout receiver 14. The varied elements of such a down spout 12 and down spout receiver 14 will be understood by those skilled in the art based on the disclosures provided herein.

FIG. 3 illustrates the installation of the down spout receiver 14 to the building 26 and the down spout 12 to the down spout receiver 14. As shown in FIG. 3, the down spout receiver 14 includes a sealing flange 28 that seals against the exterior sheathing 30 of the building 26. The down spout receiver 14 further includes a pair of siding channels 32, which engage the siding 34. In the example shown in FIG. 3, the down spout receiver 14 is secured to the building 26 by a pair of fasteners 36. Of course, it is understood that while only two fasteners 36 are shown in the cross-sectional view presented in FIG. 3, a greater number of fasteners 36 will be used along the length of the installation (see, e.g., FIGS. 4, 6, 8). In addition, while shown as screws, the fasteners 36 may take any form appropriate for securing the down spout receiver 14 to the building 26, as will be apparent to those skilled in the art based on the disclosures provided herein.

As noted, the example of the down spout receiver 14 shown in FIG. 3 is one that provides a snap-locking fit to the down spout 12. Accordingly, the down spout receiver 14 includes a tab 38 and a snap-lock tab 40, for mating with a removable down spout 12, as described further herein.

The down spout 12 shown in FIG. 3 is an outside corner down spout 12. As shown, the down spout 12 includes a socket 42 for mating with the tab 38 and a ramp surface 44 and retainer 46 for mating with the snap-lock tab 40. These five elements cooperate to form a secure, releasable, snap-fit connection between the down spout 12 and the down spout retainer 14.

As further shown in FIG. 3, the down spout 12 includes an exposed front 48 and a down spout channel 50. The exposed front 48 may be decorative or otherwise adorned, although it is contemplated that nearly any appearance may be provided. In the preferred embodiment, the exposed front 48 is designed to substitute for standard outside corner trim used in residential construction.

Turning back to FIG. 2, further description is provided regarding the various elements of the outside corner down spout assembly 100. As shown, the top conveyor arm 16 includes a top conveyor arm inlet 52, a sloped body 54, and a top conveyor arm outlet 56. The top conveyor arm inlet 52 shown in FIG. 2 is shaped to collect water from a standard gutter outlet, though it is understood the top conveyor arm inlet 52 may take various forms to accomplish the advantages of the hidden down spout system 10. In the example shown, the top conveyor arm outlet 56 is a generally rectangular shape that corresponds to a top cap inlet 58, but the shape of the top conveyor arm outlet 56 and top cap inlet 58 may be provided as any mating form that enables water to flow from the top conveyor arm 16 to the top cap 18.

The top cap 18 shown in FIG. 2 includes the top cap inlet 58 and a top cap outlet 60. The top cap body 62 transitions in shape from the top cap inlet 58 which is shaped to mate with the top conveyor arm 16 to a shape adapted to mate with the down spout 12 at the top cap outlet 60. Accordingly, the top cap outlet 60 is adapted to mate with the down spout channel 50.

The optional down spout connector 20 shown in FIG. 2 includes a down spout connector inlet 64 and a down spout connector outlet 66. In use, a first down spout 12 is inserted into the down spout connector inlet 64 and the down spout connector outlet 66 is inserted into the down spout channel 50 of a second down spout 12. This can be done to extend the length of down spout 12. The down spout connector 20 can take any form appropriate to mate multiple lengths of down spout 12 into a single functional down spout 12.

At the bottom of the down spout 12, the bottom down spout transition cap 22 includes a bottom down spout transition cap inlet 68 and a bottom down spout transition cap outlet 70. As described above, the down spout bottom transition cap 22 makes the transition from the shape of the down spout 12 to the shape of a standard below grade storm water drain tile (not shown). If a below grade drain tile is not being used, then an on-grade discharge transition cap 22 makes the transition from the down spout bottom transition cap 22 to a standard 4×5 down spout pipe 24.

Figure 4:
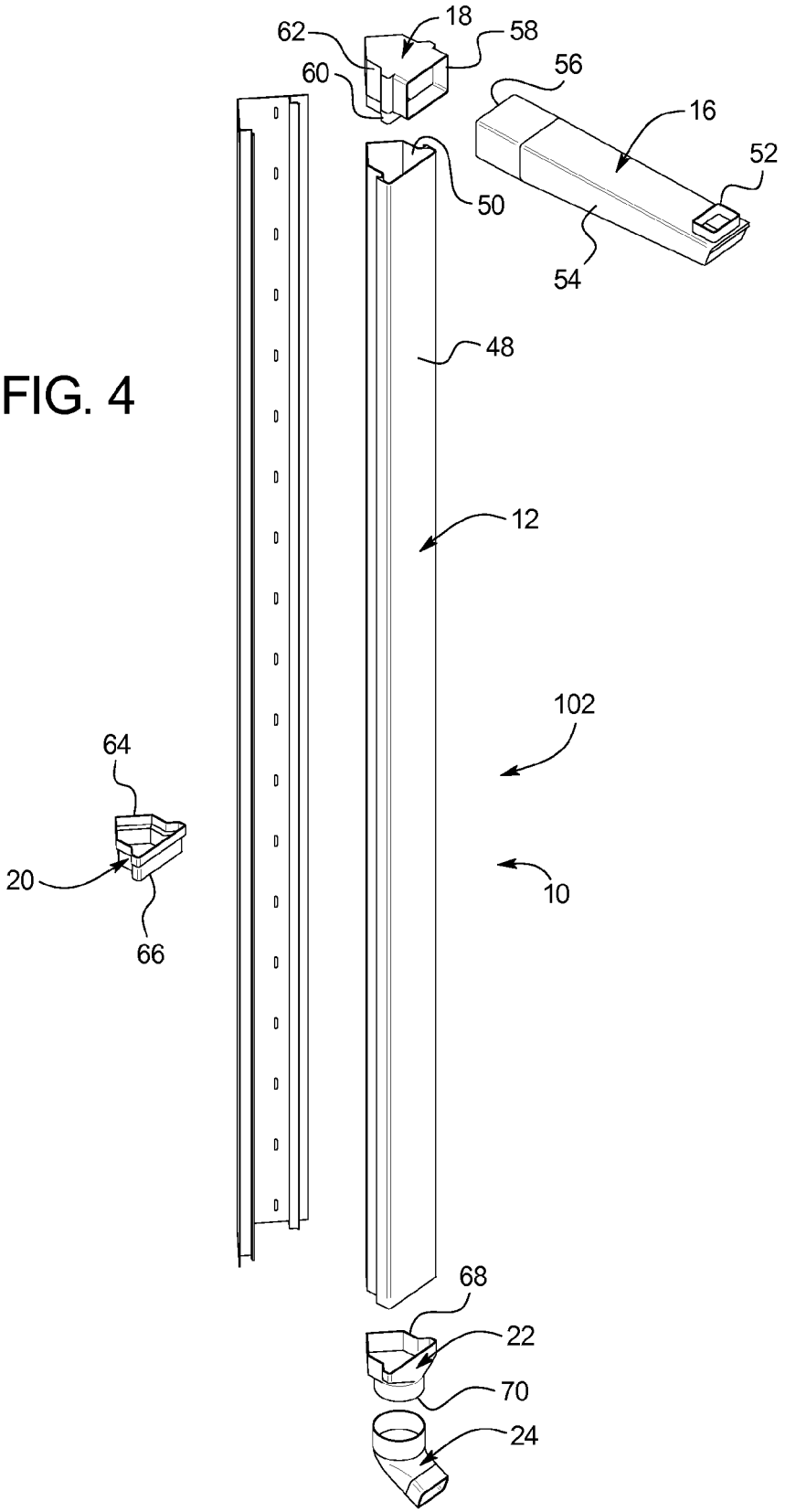
FIG. 4 is an exploded view of an inside corner down spout assembly.
Figure 5:
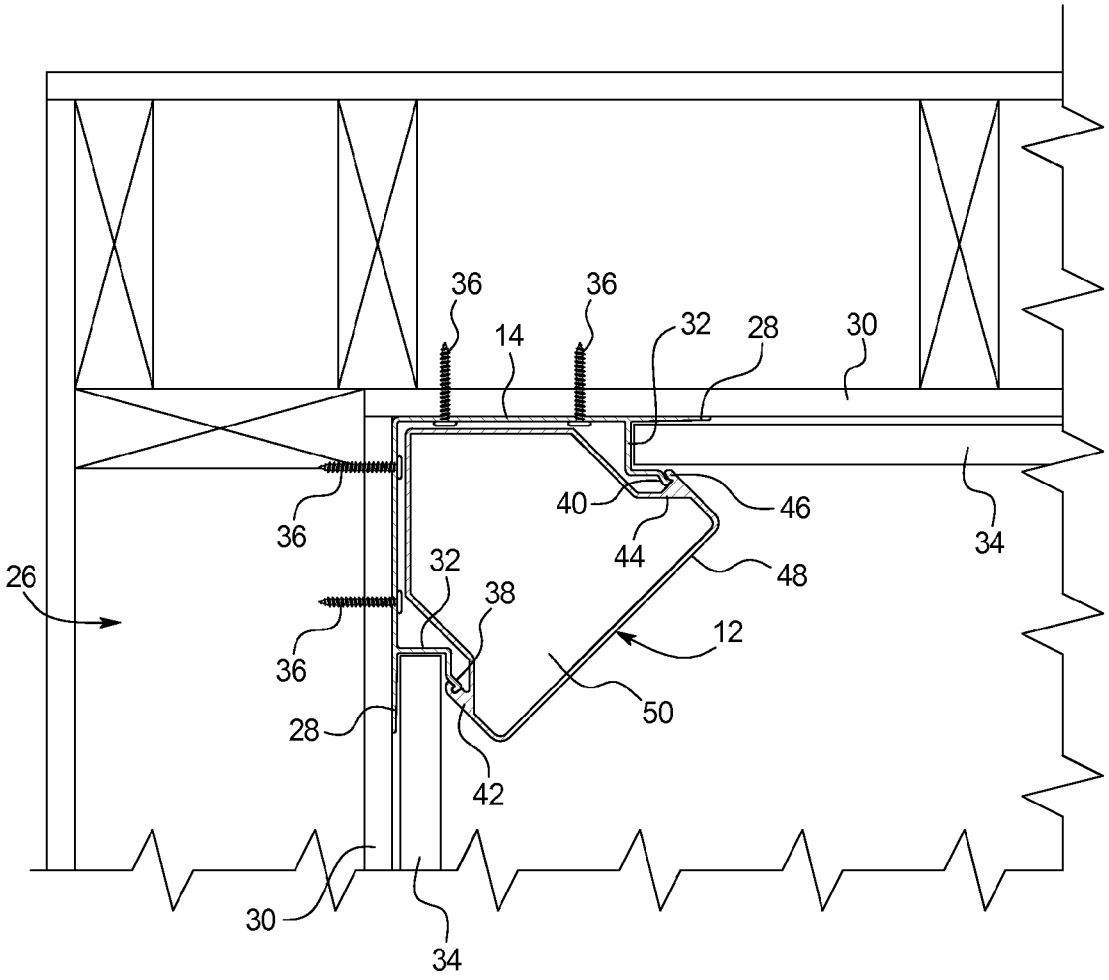
FIG. 5 is a cross-sectional view of the inside corner down spout assembly shown in FIG. 4, further illustrating the attachment of the inside corner down spout receiver to the building and the inside corner down spout to the inside corner down spout receiver.
Figure 6:
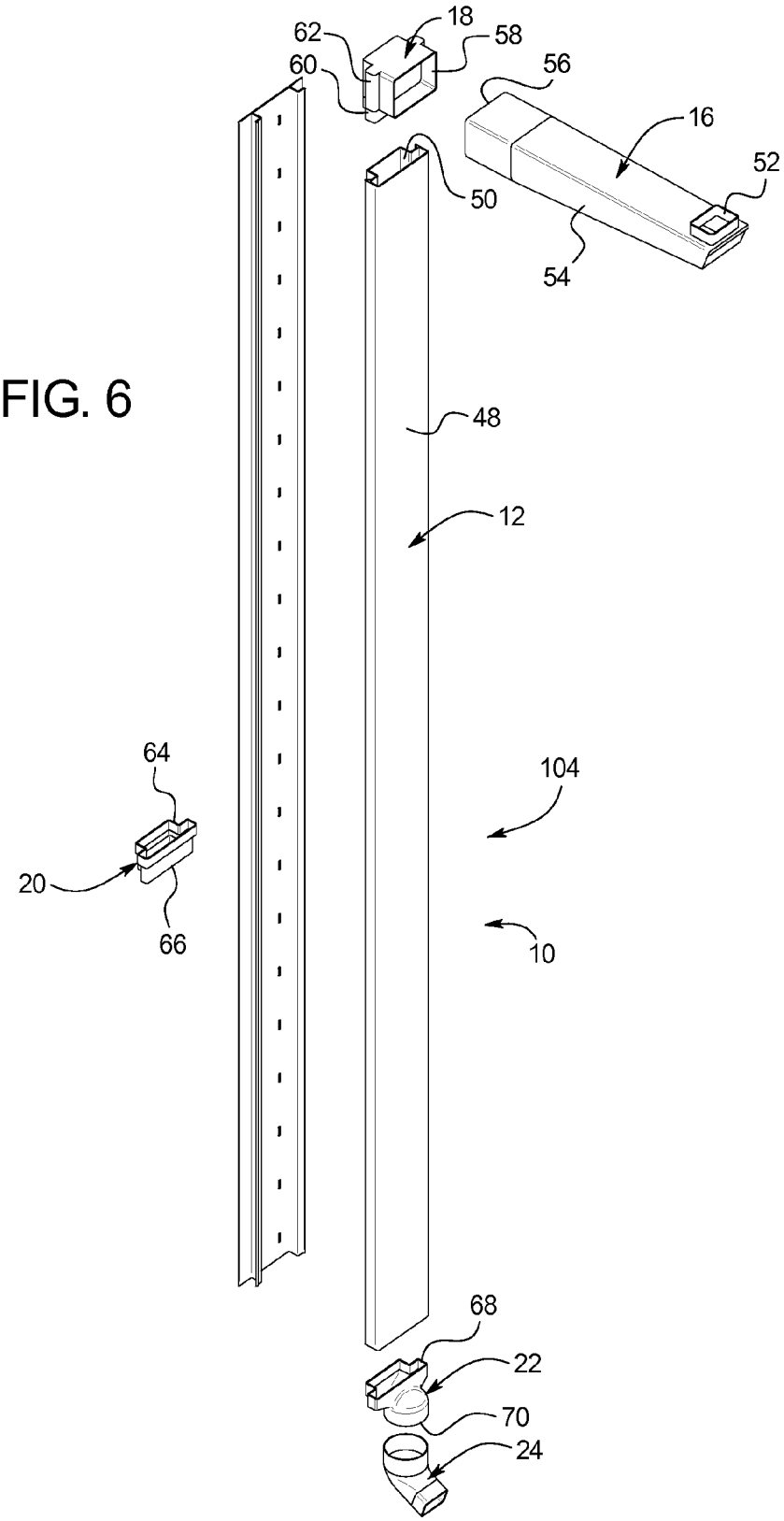
FIG. 6 is an exploded view of a straight down spout assembly.
Figure 7:
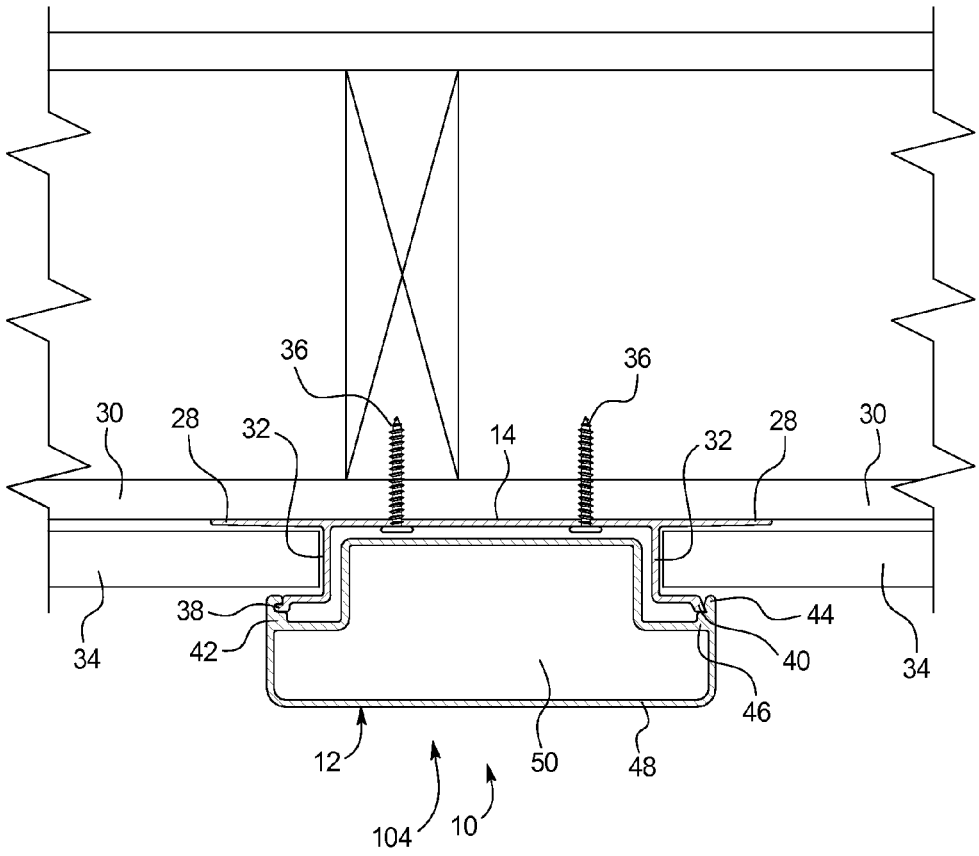
FIG. 7 is a cross-sectional view of the straight down spout assembly shown in FIG. 6, further illustrating the attachment of the straight down spout receiver to the building and the straight down spout to the straight down spout receiver.

FIGS. 1B, 4, and 5 show an inside corner down spout assembly 102 and FIGS. 1C, 6, and 7 shown a straight down spout assembly 104. As shown, the elements of the inside corner down spout assembly 102 and the straight down spout assembly 104 are analogous to those of the outside corner down spout assembly 100. The notable difference between the three embodiments shown in FIGS. 1A-1C and 2-7 is the shape of the down spout 12 and the down spout retainer 14, with the inside corner down spout assembly 102 having elements shaped to replace the standard trim on an inside corner and the straight down spout assembly 104 having elements that are shaped to be positioned approximately flat against the side of the building 26.

Figure 8:
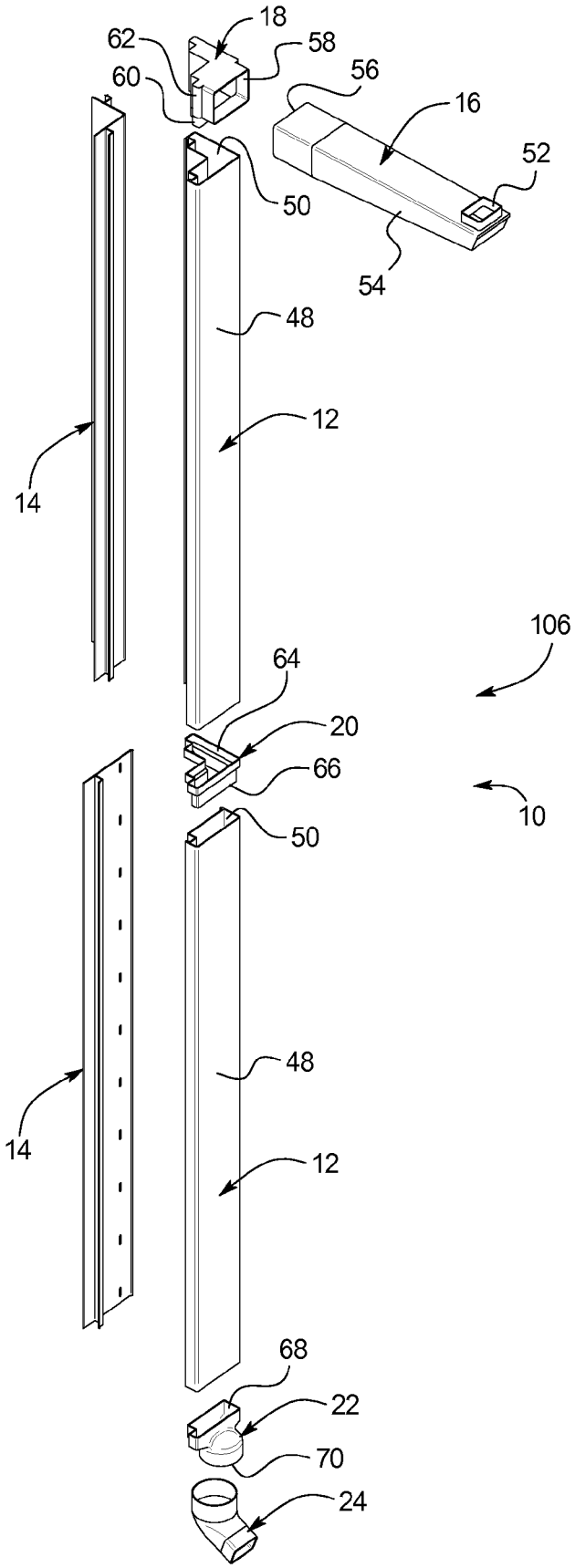
FIG. 8 is an exploded view of an outside corner down spout assembly with brick transition.
Figure 9:
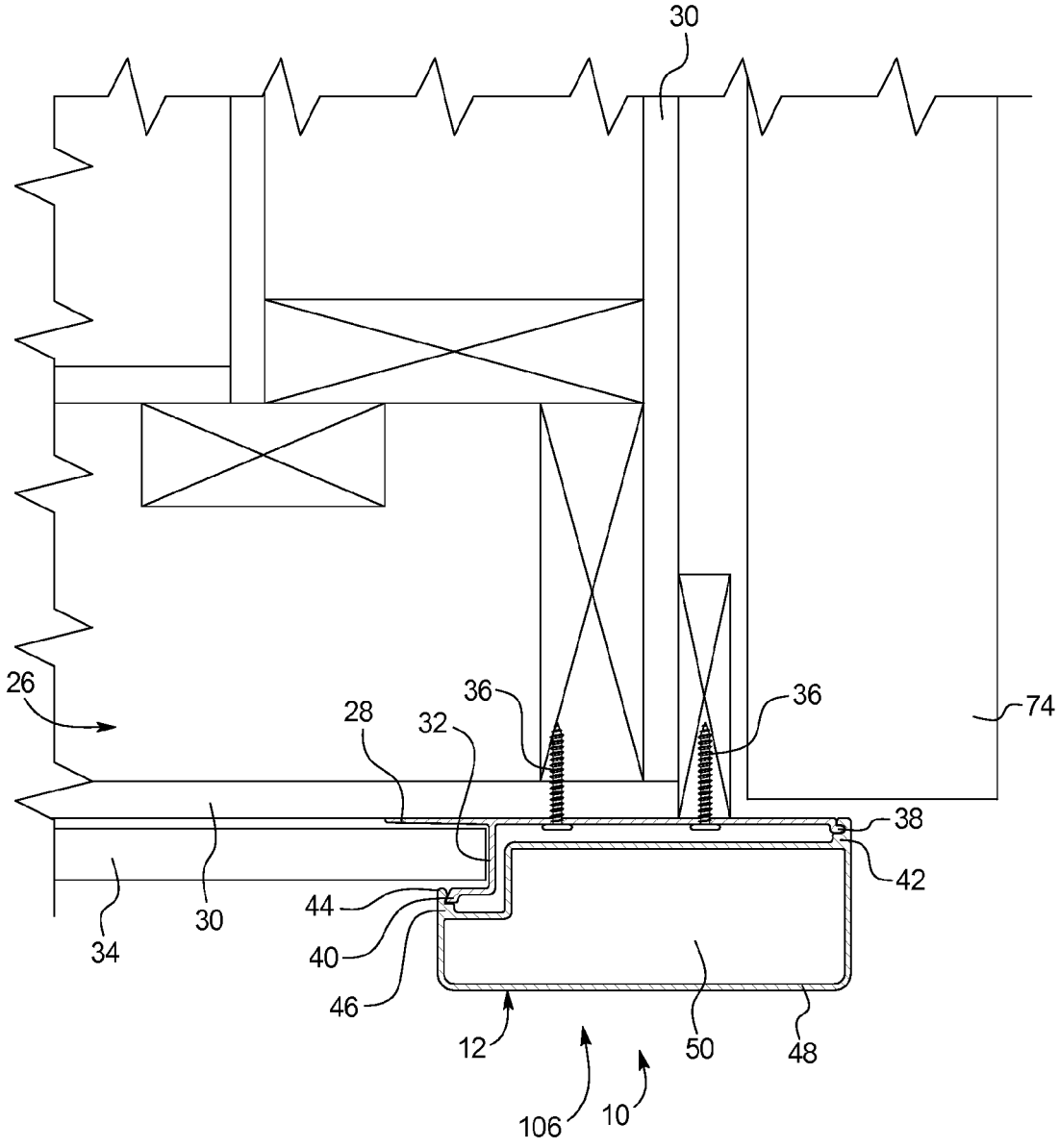
FIG. 9 is a cross-sectional view of the outside corner down spout assembly with brick transition shown in FIG. 8, further illustrating the attachment of the outside corner down spout receiver to the building and the outside corner down spout to the outside corner down spout receiver.

FIGS. 1D, 8, and 9 show an outside corner down spout assembly with brick transition 106. As shown, the outer envelope of the building 26 includes a siding section 72 above a brick section 74. Accordingly, to match the changing structure of the building 26, the outside corner down spout assembly with brick transition 106 uses two differently shaped down spouts 12 and two differently shaped down spout retainers 14. Accordingly, the top portion of the outside corner down spout assembly with brick transition 106 is the same as the outside corner down spout assembly 100 shown in FIGS. 1A, 2, and 3. Below the down spout connector 20, the down spout 12 and the down spout receiver 14 take a different shape, shown in greater detail in FIGS. 8 and 9.

As shown in FIGS. 8 and 9, the down spout receiver 14 includes only a single siding channel 32. The side of the down spout receiver 14 that interfaces with the brick section 74 is a flat sealing flange 28.

In order to transition from the upper down spout 12 to the lower down spout 12, the down spout connector 20 has a down spout connector inlet 64 shaped to mate with the upper down spout 12 and a down spout connector outlet 66 shaped to mate with the lower down spout 12.

As described above, certain embodiments of the present invention relate to a hidden down spout system 10 with a non-removable down spout 12. In such examples, the hidden down spout system 10 may include: a down spout 12; a top conveyor arm 16; a top cap 18; an optional down spout connector 20; a bottom down spout transition cap 22; and, optionally, an on-grade discharge transition cap 24. As described, there may not be a need to a separate down spout receiver 14 when the down spout 12 is a non-removable down spout 12.

Figure 10:
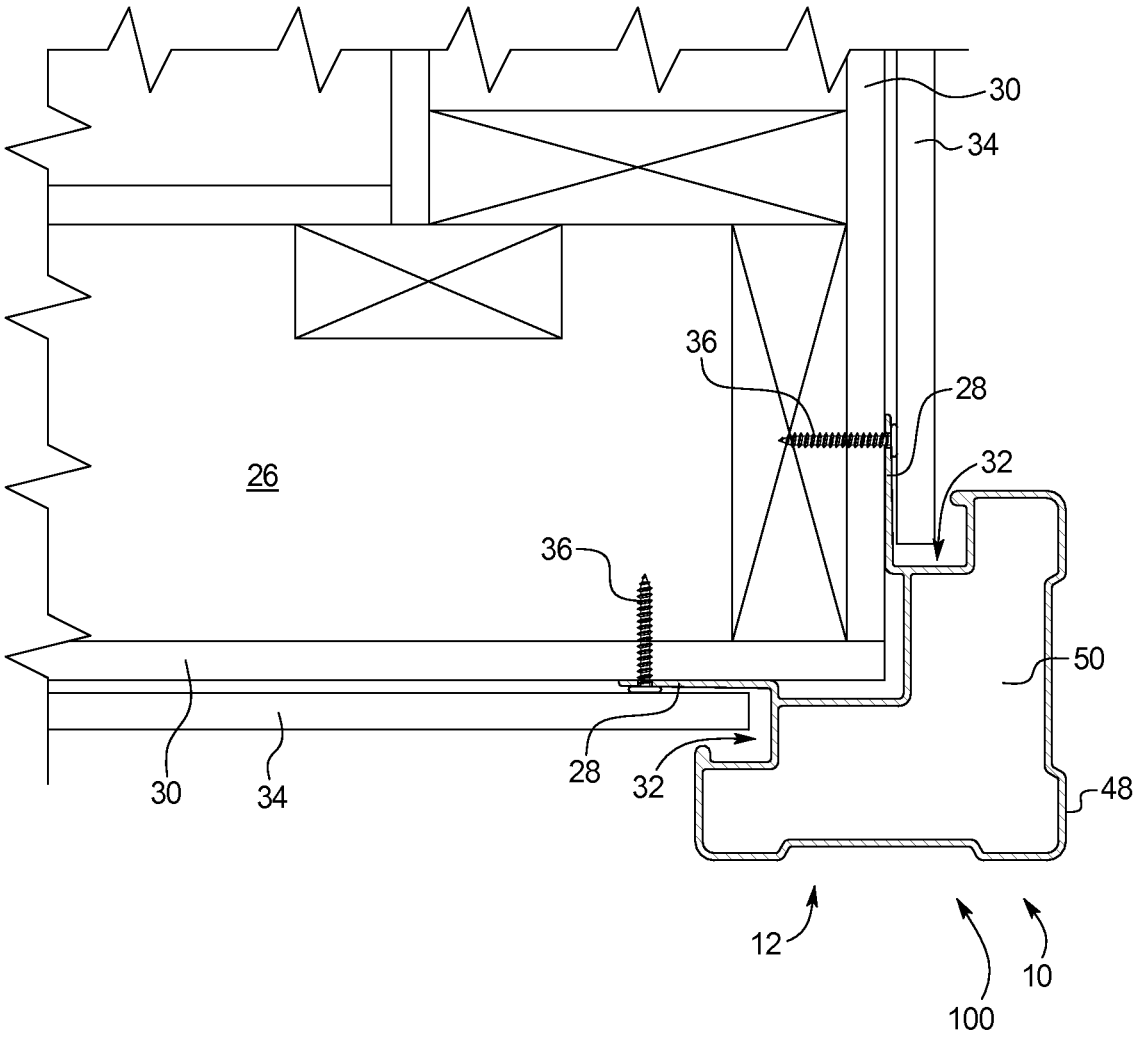
FIG. 10 is a cross-sectional view of an example of an outside corner non-removable hidden down spout assembly.

FIG. 10 illustrates as example of a hidden down spout system 10 in which the down spout 12 is non-removable. The hidden down spout system 10 shown is an outside corner down spout assembly 100. As shown, the hidden down spout system 10 includes a down spout 12 including a sealing flange 28 that seals against the exterior sheathing 30 of the building 26. The down spout 12 further includes a pair of siding channels 32, which engage the siding 34. In the example shown in FIG. 10, the down spout 12 is secured to the building 26 by a pair of fasteners 36. Accordingly, as shown, when provided in a non-removable form, the down spout 12 may take on some of the characteristics of the down spout receiver 14 shown and described with respect to FIGS. 2-9. As further shown, the down spout 12 includes an exposed front 48 and a down spout channel 50, similar to the examples of down spouts 12 shown in FIGS. 2-9.

The example of the hidden down spout system 10 shown in FIG. 10 may be adapted to be used with: a top conveyor arm 16; a top cap 18; an optional down spout connector 20; a bottom down spout transition cap 22; and, optionally, an on-grade discharge transition cap 24. Accordingly, this embodiment of a non-removable down spout 12 essentially replaces the down spouts 12 and down spout receivers 14 in the examples provided in FIGS. 2-9. For purposes of clarity herein, the term "down spout unit" is used to refer to both: (1) a non-removable down spout 12; and (2) a combination of a removable downs spout 12 and a down spout receiver 14.

While the non-removable down spout 12 embodiment is described herein with respect to an outside corner down spout assembly 100, it is understood that the principles may be applied to any of hidden down spout systems 10, whether the outside corner down spout assembly 100, the inside corner down spout assembly 102, the straight down spout assembly 104, etc.

The examples provided above are illustrative of a number of features and structural elements that may be incorporated into a hidden down spout system 10. It should be noted that various changes and modifications to the presently preferred embodiments described herein will be apparent to those skilled in the art. Such changes and modifications may be made without departing from the spirit and scope of the present invention and without diminishing its attendant advantages. For example, various embodiments of a hidden down spout system 10 may be provided based on various combinations of the features and functions from the subject matter provided herein.

I claim:

1. A hidden down spout system comprising:

a down spout receiver adapted to be secured to a building by a fastener;

a down spout adapted to be secured to the down spout receiver through a snap fit connection, wherein the down spout is an outside corner down spout having one continuous hollow channel, wherein a cross section of the channel spans an outside corner of the building, wherein, when the down spout is secured to the down spout receiver, a space is maintained between an outer surface of the down spout receiver and an inner surface of the down spout, wherein a portion of the fastener is positioned in at least a portion of the space between the down spout and the down spout receiver;

a top conveyor arm adapted to receive water from a gutter; and a top cap connecting the top conveyor arm to the down spout such that water flowing from the top conveyor arm flows to the down spout.

2. The hidden down spout system of claim 1 wherein the top conveyer arm extends perpendicular from a length of the down spout.

3. The hidden down spout system of claim 1 wherein the down spout receiver includes a tab and a snap-lock tab and the down spout includes a socket adapted to receive the tab and further includes a ramp surface and retainer adapted to receive the snap-lock tab.

4. The hidden down spout system of claim 1 wherein the down spout receiver includes a sealing flange.

5. The hidden down spout system of claim 1 wherein the down spout receiver includes one or more siding channels.

6. The hidden down spout system of claim 1 further including a down spout transition cap adapted to mate with the down spout.

7. The hidden down spout system of claim 1 further including a down spout connector mating a second down spout to the down spout.

8. The hidden down spout system of claim 1 wherein the down spout is configured as an outside corner down spout.

9. The hidden down spout system of claim 1 wherein the down spout is configured as an inside corner down spout.

10. The hidden down spout system of claim 1 wherein the down spout is configured as a straight down spout.

11. A hidden down spout system comprising:

a down spout receiver including a sealing flange, one or more siding channels, a tab, and a snap-lock tab, wherein the down spout receiver is secured to a building by a fastener; and a down spout adapted to snap-fit to the down spout receiver, wherein the down spout includes a socket adapted to receive the tab and further includes a ramp surface and retainer adapted to receive the snap-lock tab, wherein the down spout is an outside corner down spout having one continuous hollow down spout channel, wherein a cross section of the down spout channel spans an outside corner of a building, wherein, when the down spout is secured to the down spout receiver, a space is maintained between an outer surface of the down spout receiver and an inner surface of the down spout wherein a portion of the fastener is positioned in at least a portion of the space between the down spout and the down spout receiver.

12. The hidden down spout system of claim 11 further including a top conveyor arm adapted to receive water from a gutter and a top cap connecting the top conveyor arm to the down spout such that water flowing from the top conveyor arm flows to the down spout.

13. The hidden down spout system of claim 11 further including a down spout transition cap adapted to mate with the down spout.

14. The hidden down spout system of claim 11 further including a down spout connector mating a second down spout to the down spout.

15. The hidden down spout system of claim 11 wherein the down spout is configured as an outside corner down spout.

16. The hidden down spout system of claim 11 wherein the down spout is configured as an inside corner down spout.

17. The hidden down spout system of claim 11 wherein the down spout is configured as a straight down spout.

18. A hidden down spout system comprising:

a down spout unit including a sealing flange, one or more siding channels, and a down spout channel, wherein the down spout channel is one continuous hollow channel, wherein a cross section of the down spout channel is configured to span an outside corner of a building, wherein, when the sealing flange is secured to the building by a fastener, a space is maintained between an outer surface of the sealing flange and an inner surface of the down spout, wherein a portion of the fastener is positioned in at least a portion of the pace between the down spout and the sealing flange;

a top conveyor arm adapted to receive water from a gutter; and a top cap connecting the top conveyor arm to the down spout such that water flowing from the top conveyor arm flows to the down spout.

19. The hidden down spout system of claim 18 wherein the down spout unit includes a down spout and a down spout receiver, wherein the down spout receiver includes the sealing flange and the one or more siding channels and the down spout includes the down spout channel.

20. The hidden down spout system of claim 18 wherein the down spout unit includes a down spout including the sealing flange, and the one or more siding channels, and the down spout channel.

21. The hidden down spout system of claim 1 wherein the down spout receiver spans a corner of the building, wherein the down spout receiver includes a first end and a second end, wherein the first end is positioned adjacent to a first side of the building, wherein the second end is positioned adjacent to a second side of the building, wherein the first side of the building and the second side of the building form the corner of the building, wherein the down spout chamber extends continuously from the first end to the second end.

22. The hidden down spout system of claim 11 wherein the down spout receiver spans a corner of the building, wherein the down spout receiver includes a first end and a second end, wherein the first end is positioned adjacent to a first side of the building, wherein the second end is positioned adjacent to a second side of the building, wherein the first side of the building and the second side of the building form the corner of the building, wherein the down spout chamber extends continuously from the first end to the second end.

23. The hidden down spout system of claim 18 wherein the down spout unit includes a down spout and a down spout receiver, wherein the down spout includes the down spout channel, wherein the down spout receiver includes a first siding channel and a second siding channel, where and a first siding channel and second siding channel are positioned adjacent to opposite sides of a building corner, and wherein the down spout channel extends from the first siding channel to the second siding channel.

* * * * *